United States Patent [19]

Grace et al.

[11] Patent Number: 4,822,213

[45] Date of Patent: Apr. 18, 1989

[54] NARROW ACCESSWAY SEWAGE COLLECTION TANK ASSEMBLY, REMOTE OPERATED QUICK CONNECT-DISCONNECT COUPLING AND SYSTEM USING THE SAME

[75] Inventors: Richard C. Grace, Carlisle; Jack L. Cooley, Clifton Park; Eric F. Cabahug, Schenectady, all of N.Y.

[73] Assignee: Environment/One Corporation, Schenectady, N.Y.

[21] Appl. No.: 139,833

[22] Filed: Dec. 30, 1987

[51] Int. Cl.[4] ..... E02D 29/12; B02C 23/36; B02C 13/18

[52] U.S. Cl. ..... 405/303; 52/20; 137/363; 241/36; 241/46.17; 241/46.02; 405/36

[58] Field of Search ..... 405/36, 52, 303; 241/36, 46.02, 46.17, 46.06, 46 B, 258; 52/20; 417/435; 137/363, 395, 544, 567

[56] References Cited

U.S. PATENT DOCUMENTS

| | | | |
|---|---|---|---|
| 1,520,230 | 12/1924 | Flath | 52/20 X |
| 2,894,698 | 7/1959 | Brucken | 241/46 B |
| 2,945,592 | 7/1960 | Honeyman | 241/46.02 X |
| 3,461,803 | 8/1969 | Stothoff et al. | 137/363 X |
| 3,672,103 | 6/1972 | Kost | 137/363 X |
| 3,857,517 | 12/1974 | Grace et al. | 241/36 |
| 4,178,139 | 12/1979 | Seppanen et al. | 52/20 X |
| 4,709,723 | 12/1987 | Sidaway et al. | 52/20 X |

*Primary Examiner*—Dennis L. Taylor
*Attorney, Agent, or Firm*—Charles W. Helzer

[57] ABSTRACT

A narrow-accessway sewage collection tank assembly and system using a remote operated, two-part, slide coupling for supporting a sewage pump within an enlarged collection tank for installation outside below normal ground level of residences, commercial and industrial buildings for use in the collection and disposal of sewage produced in the buildings. The narrow accessway tank system can be installed with minimum cost and impact on the environment while maintaining proper operating conditions, good scouring of the collection tank bottom and facilitating below ground installation and subsequent maintenance and servicing of the sewage pump unit form the surface. The system comprises an enlarged sewage collection tank to be planted below level in the ground near a building and connected to suitable gravity drain conduits interconnected between the facility to be serviced and the collection tank for collecting raw sewage. The sewage pump unit comprises a sewage grinder pump physically supported within the enlarged collection tank for grinding and pumping the liquid sewage including any entrained solids out through a pressure sewage discharge outlet conduit to a suitable sewage disposal installation such as a drain field. A narrow-access passageway enclosure is physically supported on top of the collection tank and provides access to the sewage grinder pump unit within the interior of the tank. The narrow-access passageway is of sufficient cross-sectional dimension to allow free passage up and down for the sewage grinder pump unit, but is insufficient in cross section to accommodate passage of human beings or to accommodate a pipe guide system of conventional construction. A two-part, quick connect-disconnect slide coupling is provided for physically supporting the sewage grinder pump unit within the collection tank properly positioned relative to the bottom to assure proper scouring and prevent build-up of solids, but allows ready removal of the sewage grinder pump unit from the surface by a serviceman using a remotely operated tool to decouple the grinder pump unit via the quick connect-disconnect slide coupling and withdrawing it upwardly through the narrow-access passageway enclosure to the surface for service and maintenance or replacement.

32 Claims, 4 Drawing Sheets

32P
32
22F
21E
46
44
25
26
22ST
21S
29
22P
45
OPEN
21
21P
45
21S
22F
CLOSED
28
21L
46
27
24
43
31
22
32
31P
37
35
33
39
41L
34
36
38
41
42
41R

NARROW ACCESSWAY SEWAGE COLLECTION TANK ASSEMBLY, REMOTE OPERATED QUICK CONNECT-DISCONNECT COUPLING AND SYSTEM USING THE SAME

FIELD OF INVENTION

This invention relates to a new and improved narrow accessway sewage collection tank assembly and a system employing the same.

More specifically, the invention relates to a narrow accessway sewage collection tank assembly for use where the assembly is to be installed outside of a building below normal ground level. The novel collection tank assembly has a narrow accessway enclosure connecting the top of the collection tank to the surface of the ground. The narrow access enclosure is of sufficient cross sectional dimension to allow for passage of a basic sewage-pump unit, but not human beings, nor will it accommodate a conventional guide rail system normally used for sewage pumps. Use of the new assembly results in a minimal structure protrusion at grade level, minimum ballast requirements and minimum material usage while still allowing the collection tank to be of sufficient size to accommodate necessary sewage storage.

The invention further provides a novel, remote operated quick connect-disconect, coupling that can be actuated from the surface of the ground to facilitate proper installation and replacement of the sewage pump unit in operating conditions within the buried sewage collection tank, and eliminate the need for guide rails as presently used.

BACKGROUND PRIOR ART

United States Reissue patent No. 28,104 -issued Aug. 6, 1974 to Richard C. Grace (one of the co-inventors of the subject invention) entitled "Pump Storage Grinder" and assigned to the Environment/One Corporation, describes and claims a sewage grinder pump system that has received considerable acceptance in the industry. The sewage grinder pump system disclosed in Re. 28,104 employs a sewage collection and storage tank of about 50–60 gallon capacity having a gravity fed raw sewage inlet and removable top cover. The top cover supports a liquid-tight, sealed housing having a separately removable cover and that contains a motor and motor controls for rotating a common shaft to which both a grinder or comminutor and a positive displacement pump rotor are secured. The storage tank serves to collect both sewage and waste water from a typical single family residence until the level of sewage is sufficient to actuate a pressure sensitive electric switch. The electric switch turns on the sewage grinder pump causing it to both macerate solids entrained in the sewage and pump the ground sewage under pressure out through a discharge outlet conduit normally having a one-way check valve therein to a suitable disposal point for the pressurized liquid sewage.

This known sewage grinder pump system was initially designed for installation in basements, crawl spaces or slabs of single family residences, small office buildings and manufacturing plants, and the like, but in the intermin has been used in many installations where it has been buried outside, in the backyard of a home for example. In some instances it is necessary to bury the sewage collection tank to a depth below the normal grade or surface of the ground thereby necessitating the installation of a large diameter manway that is substantially the same cross-sectional dimension (or greater) than the sewage collection tank such as disclosed in U.S. Pat. No. 4,014,175, issued Mar. 29, 1977. The large diameter manway is used because it was an easy and direct extension of the surface unit and may or may not employ guide rails for lowering and raising the sewage grinder pump unit together with junction boxes, shutoff valves, disconnect means and the like. In order to accommodate these parts and to allow access to the sewage grinder pump for removal, repair and maintenance or replacement, the large diameter manway is necessary. In some installations, the required manway can be as deep as 2–10 feet below ground, thus necessitating the installation of a rather extensive and costly manway facility.

In the above briefly-described, known sewage grinder pump system, the electric motor for the grinder pump and its controls are supported within a liquid-tight housing which normally is above the highest level of liquid sewage allowed to collect in the tank by the level sensing switch used to control the grinder pump motor. The drive shaft driven by the electric motor extends down through a suitable shaft seal to drive the pump rotor and comminutor-grinder that are secured to the shaft and are disposed within the liquid sewage collected in the tank. Thus, in effect, this known sewage grinder pump constitutes an over and under dry well/wet well type of arrangement.

Combined dry well/wet well pumping systems are old in the art and have long been used in pumping both storm sewage as well as waste sewage. In these older arrangements, two wells are driven side by side into the round, one of which is maintained dry and the other of which serves to collect the liquid to be pumped. Such wet well/dry well systems are described in the "Submersible Sewage Pumping Systems Handbook" published by Lewis Publishers, Inc., 121 South Main Street, PO Drawer 519, Chelsea, Michigan 48118 USA, published 1986. For a more detailed description of the parallel, wet well/dry well arrangement reference is made to the above-noted handbook. Only a cursory comparison is required, however, to appreciate that the digging or driving of two pits to accomodate a wet well/dry well, is complex and costly, and has greater impact on the environment than the driving of a single well system.

In addition to the above two briefly described systems, the industry has further developed a single wet well system which employs submersible pumps, a description of which appears on pages 4 and 5 of the above-noted "Submersible Sewage Pumping systems Handbook". Submersible pump wet well sewage systems have found acceptance, particularly in the larger rated system, but require the building of an enlarged manway to accommodate the guide rail structure used with such systems, along with necessary junction boxes, shutoff valves, disconnect mechanisms and the like.

The guide rail structure is a standard component of a single wet well submersible pump system. The rails, usually are spaced-apart galvanized pipes and are mounted in place from the bottom of the wet well to the access cover. A bracket on the pump unit mates with the rails so as to properly support the pump when it is in place at the bottom of the wet well and to resist torque by the sewage pump motor while operating. During initial installation, the submersible pump or pumps are lowered into place on the guide rails and fitted to a discharge pipe by means of a quick connect-disconnect mechanism. The guide rail structure normally is a substantial, component part of a submersible pump type wet well and takes up a lot of space in the well so that an accessway comparable in cross-sectional dimensions and size to the collection tank is required.

A hoist normally is used to install the pump or to remove the pump for inspection or servicing. The hoist may be a portable hoist, truck mounted or be a permanent part of the wet well installation. A chain or cable is attached to a bracket on the top of the submersible pump, and the pump is lifted into or out of the well while being guided by the guide rails. During removal a sealing flange on a quick connect-disconnect coupling mechanism disengages from the discharge pipe so that the submersible pump can be raised to the top of the well guided by the guide rail system. After inspection and servicing, or upon initial installation, the submersible pump is lowered back into the wet well along the guide rails so that the sealing flange of the quick connect-disconnect coupling automatically engages the discharge pipe and the system is ready for operation. The guide rail system also must be designed to resist the torque developed by the submersible pump during operation so that it is necessarily strong and bulky.

To overcome the above briefly-discussed problems of pressurized sewage disposal installations which are to be buried in the ground outside the facility which they serve, the present invention was devised.

SUMMARY OF INVENTION

It is therefore a primary object of the present invention to provide a narrow accessway sewage pump collection tank assembly for installation below normal ground level at a sewage collection and disposal facility with minimum cost and impact on the environment while maintaining proper operating conditions, good scouring of the collection tank bottom during operation of the sewage pump, adequate storage capacity in the wet well, and facilitating below ground installation and subsequent maintenance and servicing, or replacement from the surface, if required. The enlarged collection tank, which can be buried from 2 feet up to about 10 feet below the surface of the ground, has a narrow-access passageway enclosure physically supported on its top which provides access to the interior of the tank. The narrow-access passageway is of sufficient cross-sectional dimension to allow for free passage of the basic grinder-pump unit while requiring a minimal structural protrusion at the grade level, minimum ballast requirements and minimum material usage and yet providing a sufficient size wet well to accommodate necessary sewage storage.

Another object of the invention is to provide a novel, quick connect-disconnect, slide coupling for use in the above briefly-described narrow access sewage collection tank assembly which serves to physically support a sewage grinder pump within the enlarged sewage collection tank. The coupling can be readily manipulated by a serviceman from the surface of the ground above the sewage collection tank for installing or removing the sewage grinder pump through the narrow accessway enclosure. The quick connect-disconnect, slide coupling, in addition to locating and holding a sewage grinder pump within the sewage collection tank, also serves to resist torque produced by the sewage grinder pump motor while operating and to establish a sealed, liquid pressure tight sewage discharge outlet connection between the discharge of the sewage grinder pump and an outlet conduit for transporting ground pressurized sewage away from the collection tank to a disposal facility.

Still another object of the invention is the provision of a sewage pump collection and disposal system having the above briefly-described characteristics, but which further includes a discharge outlet stop valve located on the quick connect-disconnect slide coupling. The stop valve readily is moved into its closed position upon the installed sewage grinder pump being removed from the sewage collection tank through the narrow-access passageway. Thus, it is further assured that any pressurized sewage contained in the pressure sewage discharge outlet conduit and any pressurized sewage disposal network conduits to which it might be connected, will not back up and flood the collection tank including the narrow-access passageway enclosure while the grinder pump unit is removed.

In practicing the invention, a narrow accessway sewage grinder pump collection tank assembly is provided for installation below normal ground level at a sewage collection and disposal facility with a minimum cost and impact on the environment. The assembly allows prior burial of a pre-installed sewage collection tank below ground level of a facility to be services together with hook-up to the gravity drain conduit system feeding the collection tank. The assembly is so designed that it facilitates below ground installation of a grinder pump by a serviceman from the surface and subsequent removal for maintenance, service or replacement (if required). The assembly is used with an includes a narrow accessway enclosure extending between the pre-installed sewage collection tank and the surface of the ground. The narrow-access passageway enclosure is physically supported on the top of the collection tank and provides access to the interior of the collection tank from the surface of the ground. The narrow-access passageway is of sufficient cross-sectional dimension to allow for free passage of the basic sewage grinder pump unit while requiring only a minimal structural protrusion at the grade level, minimum ballast requirements and minimum material usage and yet provides a sufficient size wet well to satisfy necessary sewage storage.

Another feature of the invention is the provision of a novel, quick connect-disconnect, slide coupling for physically supporting a sewage grinder pump within the collection tank so that it is properly positioned relative to the bottom to assure good scouring and prevent build-up of solids, and is sufficiently sturdy and physically strong to absorb torque induced by the grinder pump unit motor.

Still a further feature of the invention is the provision of a novel discharge outlet stop valve used in addition to a normally included oneway check valve in the sewage discharge outlet from the sewage grinder pump intermediate the quick connect-disconnect coupling and a pressure sewage discharge conduit leading from the sewage collection tank to a pressurized sewage disposal plant.

BRIEF DESCRIPTION OF DRAWINGS

These and other objects, features and many of the attendant advantages of this invention will be appreciated more readily as the same becomes better understood from a reading of the following detailed description, when considered in connection with the accompanying drawings, wherein like parts in each of the several figures are identified by the same reference characters, and wherein.

BEST MODE OF PRACTICING INVENTION

Figure 1:
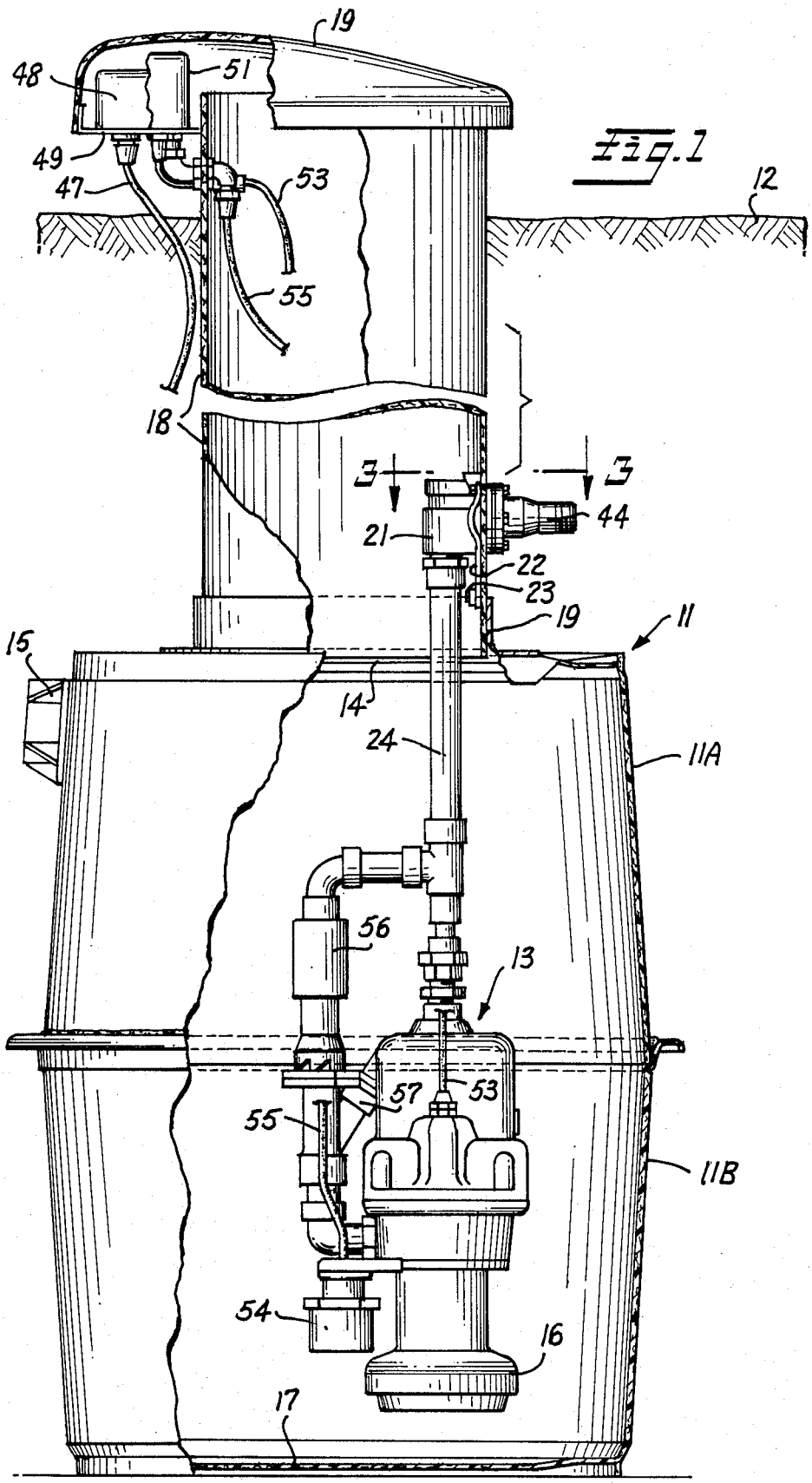
FIG. 1 is a side elevational view, partly in section, of a new and improved narrow accessway sewage pump system according to the invention.

FIG. 1 is a side elevational view of a new and improved narrow accessway sewage collection tank assembly and system according to the invention. The narrow accessway collection tank assembly is comprised an enlarged sewage collection tank 11 formed by two similar tank halves 11A and 11B that are disposed one over the other to form a barrel-shaped collection tank 11 and are permanently bonded together with a suitable adhesive such as a two-part epoxy resin. The collection tank 11 is planted in the ground to a suitable depth somewhere between 2 feet to 10 feet below the surface 12. The tank 11 when assembled may have a volume of about 50 gallons for a single family residence. For a two family or other muliple family residence, larger tanks may be used with the rule of measure being about a 50 gallon capacity for a single family unit. For the purposes of this disclosure, it is assumed that the system shown in FIG. 1 is designed for a single family residence and therefore will employ only one standard, commercially available (from the Environment/One Corporation) sewage pump unit 13. The sewage pump unit 13 preferably is of the same general construction and operating characteristics as the pump storage grinder unit described in reissue U.S. Pat. No. 28,104, and further includes an anti-siphon valve as disclosed in U.S. Pat. No. 3,857,517, issued Dec. 31, 1974 and assigned to Environment/One Corporation, the disclosures of which hereby are incorporated into the disclosure of this application in their entirety.

The sewage collection tank 11 is planted below the level of the ground 12 and is connected by means of an inlet opening, shown at 15, to a suitable gravity-type drain conduit (not shown) interconnected between the facility to be serviced and the collection tank 11 for collecting raw sewage in the collection tank. For two family and other multiple family units more than one sewage inlet opening 15 may be provided for the collection tank.

The sewage grinder pump unit 13 is physically supported within the enlarged collection tank 11 with the suction intake 16 of the pump disposed at a level below the normal low level of raw sewage collected within the tank. The suction intake 16 of the grinder pump is displaced upwardly from the bottom 17 of the tank a distance sufficient to assure ready flow of raw liquid sewage and entrained solids into the suction intake 16 and also to assure proper scouring of the bottom of the tank due to a swirling action induced in the liquid sewage at the grinder pump suction intake 16 as explained more fully in the above-referenced U.S. reissue patent No. Re. 28,104.

An elongated, narrow-access passageway enclosure 18 is physically supported over the opening 14 in the top of the collection tank 11 by means of a collar 19 secured around the periphery of the opening 14. The narrow-access passageway enclosure 18 is designed such that its cross-sectional dimension is sufficient to allow free passageway of grinder pump 13 up and down from the surface 12 to the interior of the collection tank 11. In contrast to the combined manway and collection tank assembly disclosed in U.S. Pat. No. 4,014,475, however, the narrow access manway enclosure 18 has a cross section which is insufficient to accommodate passage of an adult human being such as a serviceman. It has a minimum diameter, circular cross-sectional opening determined by the cross-sectional dimensions of the sewage grinder pump 13 which in turn is appropriately designed to maintain this cross sectional dimension at a minimum. An example of one specific embodiment of a narrow-access manway enclosure 18 has a circular cross-sectional diameter of 12 inches and can extend lengthwise from about 2–10 feet depending upon the depth below the surface to which the enlarged collection tank 11 must be planted. Similar to the collection tank 11, the narrow-access passageway enclosure 18 is fabricated from fiberglass reinforced polyester (FRP) or other similar material. At or above the surface, the narrow-access passageway enclosure 18 is capped by a hinged, lockable cap 19 also of FRP construction.

Figure 3:
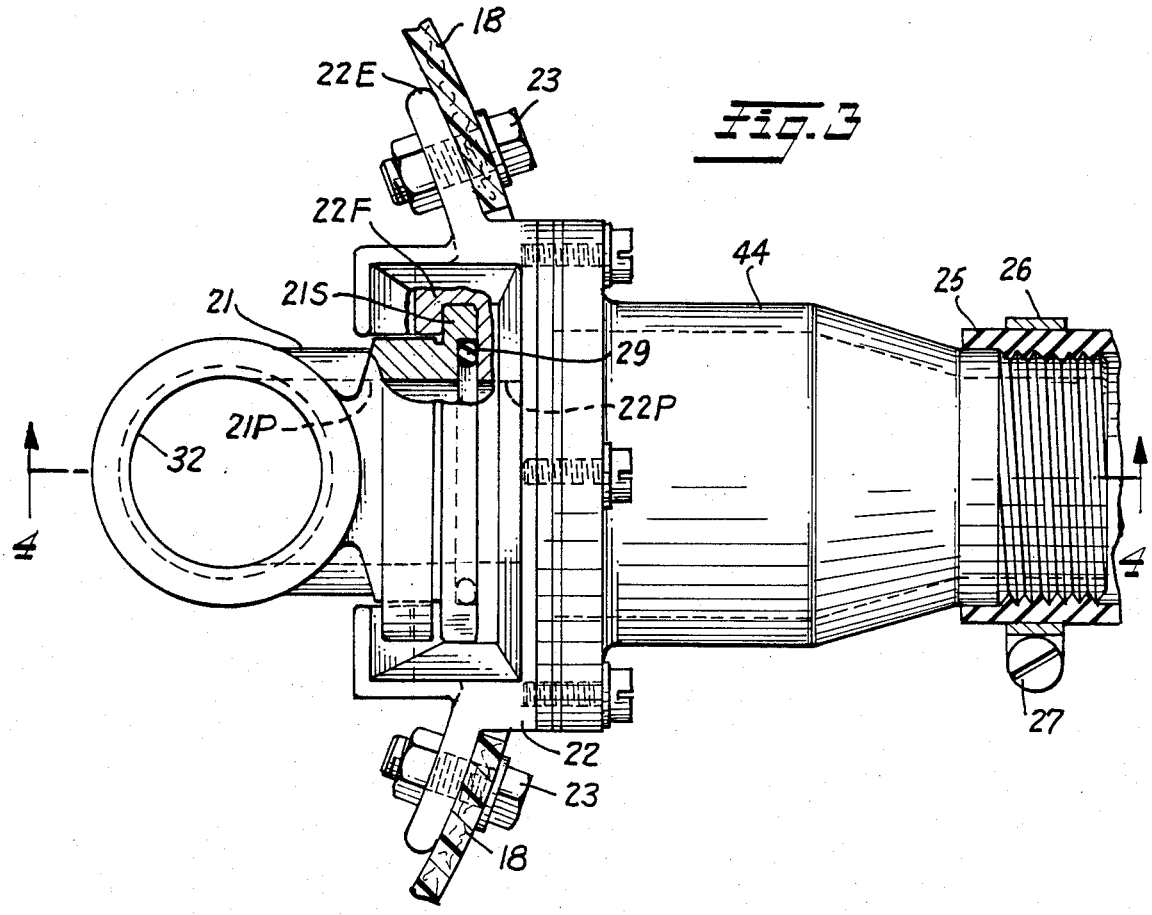
FIG. 3 is an enlarged top view of a novel quick connect-disconnect slide coupling, shown partly in section and taken along lines 3—3 of FIG. 1.
Figure 4:
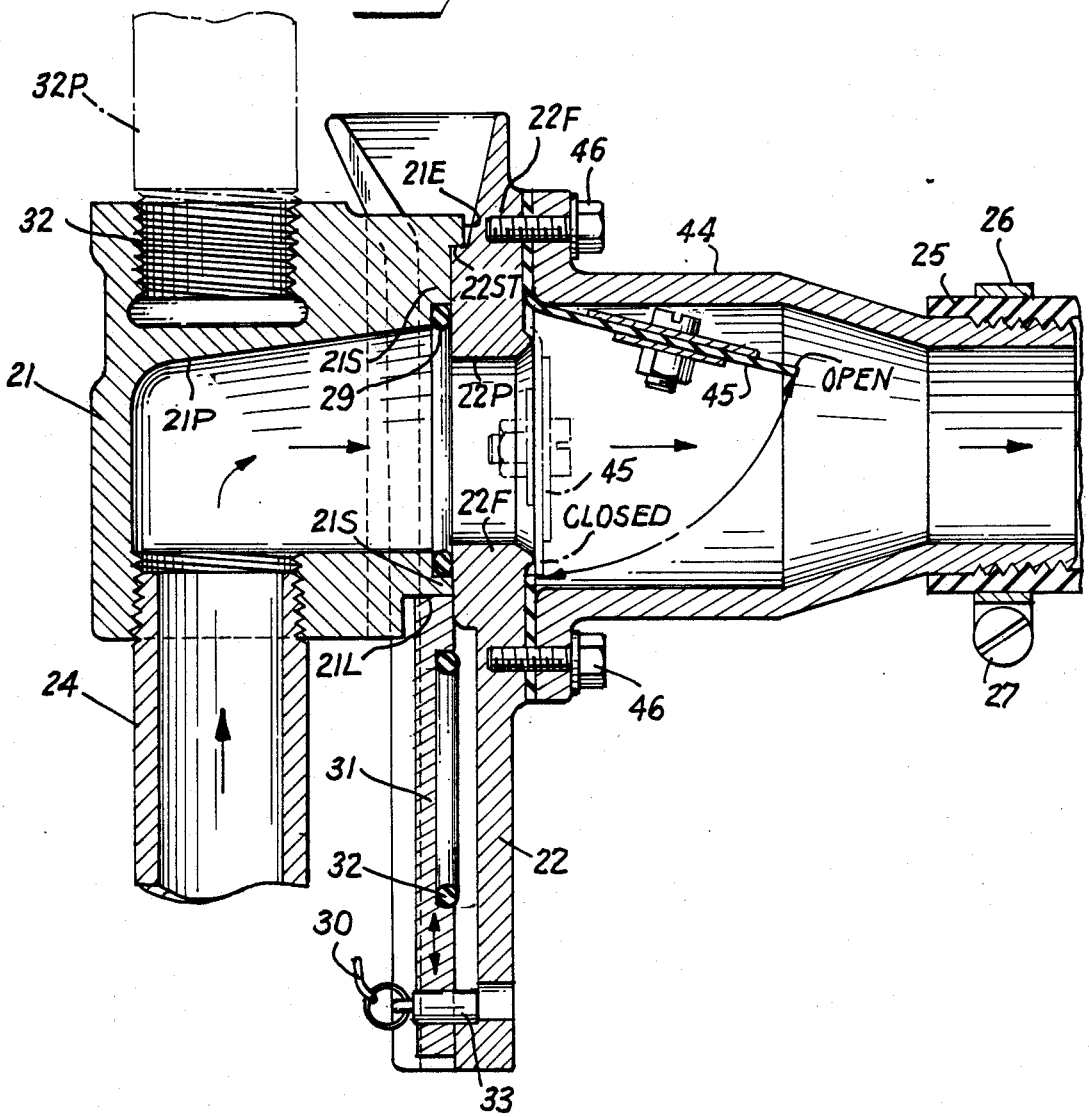
FIG. 4 is a vertical sectional view, taken on line 4—4 of FIG. 3 showing the two parts of a quick connect-disconnect slide coupling in assembled relation having an outlet check valve as a part thereof with the check valve being shown in the open position and the closed position being shown in phantom lines.

FIGS. 3 and 4 of the drawings illustrate the details of construction and operation of a novel quick connect-disconnect slide coupling which comprises a part of the narrow accessway sewage grinder pump tank assembly and system made available by the invention. The novel quick connect-disconnect coupling is composed of two parts, namely a moveable part 21 and a bayonettype, slide together, fixed part 22 which is secured to the narrow accesss passageway enclosure 18 substantially at the juncture of the enclosure with the top of the enlarged diameter collection tank 11 as best seen in FIG. 3 and FIG. 1 of the drawings. As shown in FIGS. 3 and 4, the fixed portion 22 of the coupling has a set of integrally formed, upper and lower mounting ears 22E which are widely spaced apart and are shaped to complement the curvature of the narrow access passageway enclosure 18 on the inside surface thereof. The ears are secured to the sides of enclosure 18 by suitable nuts and bolts 23 at both the upper and lower end of the fixed portion 22 of the coupling. The mounting is strong and durable so as to enable fixed portion 22 to absorb torque forces developed by the grinder pump unit 13 during operation.

Both the moveable portion 21 and fixed portion 22 of the quick connect-disconnect coupling have an internal, central open passageway formed therein, as shown at 21P for the moveable portion 21 and 22P for the fixed portion 22 in FIG. 4. Passageways 21P and 22P are axially aligned upon the two parts 21 and 22 being slid together and allow for the free flow of pressurized sewage from a sewage discharge pipe 24 connected to the discharge outlet of sewage grinder pump 13 through the two-part coupling 21, 22 to a sewage discharge outlet conduit 25. Conduit 25 serves to transport the pressurized sewage discharge from grinder pump 13 to a disposal facility for receiving the discharged sewage such as a gravity sewage pipeline, a septic tank, a dry well, a drainage field, a pressure sewer system, as disclosed in U.S. Pat. No. 3,904,131, or a sewage processing plant. The discharge conduit 25 may comprise either a 1¼ inch or 1½ inch diameter PVC pipe of whatever length is required secured by means of a stainless steel clamp 26 and set screw 27, or by standard pipe threads or cement.

The moveable portion 21 of the quick connect-disconnect coupling has a threaded opening 28 formed in the bottom thereof which communicates which the hollow, interior central passageway 21P through the center of the moveable portion. The remote end of the discharge pipe 24 from sewage grinder pump 13 is threadably secured in this threaded opening 28 for firmly interconnecting and physically supporting the sewage grinder pump 13 with the moveable portion 21 of the coupling so as to form what is essentially a rigid and physically strong assembly comprised by the moveable portion 21, discharge pipe 24 and suspended sewage grinder pump 13 for a purpose that will be appreciated more fully hereafter.

As best shown in FIGS. 3 and 4, the moveable portion 21 of the coupling on the remote end thereof from the threaded opening 28 includes an integrally formed outwardly projecting male slider surface 21S that circumferentially surrounds the central opening 21P and forms a seat for an "O" ring seal 29. The fixed portion of the quick connect-disconnect coupling has an outwardly flaring, fluted, female open upper end 22F for slidably receiving and capturing the complementary shaped male slider surface 21S formed on the confronting surface of moveable portion 21 as best seen in FIG. 3. The arrangement is such that upper lowering the moveable portion 21 (together with the attached sewage grinder pump unit 13 via rigidly connected discharge pipe 24) downwardly along the side surfaces of the narrow access passageway enclosure 18 from a position directly over the fluted female open upper end 22F of the fixed portion of the coupling, the two portions slide together readily and allow the moveable portion 21 to slide downwardly to a position such that the "O" ring seal 29 is clamped in place over a smooth confronting surface of fixed portion 22F that circumferentially surrounds the central opening 22P therein and provides a pressurized liquid tight seal between the two coupling parts. The dimensioning is such that downward movement of the moveable portion 21 is physically stopped by an upper outwardly protruding eave portion 21E that engages and is stopped by an inwardly protruding upper stepped portion 22ST. Previously, however, a lower abutting edge 21L of the male slider surface 21S comes into engagement with and drives downwardly the upper end of a slider plate 31 to its at-rest lower position, the purpose of which will be described more fully hereafter.

In order to properly position the moveable portion 21 and attached sewage grinder pump 13 over the fluted, open upper end of the fixed portion 22 of the quick connect-disconnect slide coupling during installation of the grinder pump, or for use in removal of the combined assembly of the sewage grinder pump and attached moveable portion 21, the moveable portion 21 has an internally threaded opening 32 formed on its upper surface. This internally threaded opening 32 is designed to threadably engage with a complementary threaded installation and removal pipe 32P shown in phantom line which is used only during the installation and removal of the sewage grinder pump 13 and attached moveable portion 21 of the coupling through the narrow access passageway enclosure 18. The threaded pipe 32P comprises a galvanized steel pipe of about 1 inch in diameter and therefore provides a very rigid, rugged tool for lowering and lifting the combined sewage grinder pump and moveable portion 21 of the slide coupling in and out of narrow accessway 18.

The slide plate stop valve 31 is designed to serve as a stop valve of closing off the sewage discharge passageway through central openings 22P in the fixed portion of the quick connect-disconnect slide coupling during periods while the moveable portion 21 and attached sewage grinder pump 13 are removed from the sewage collection tank 11. The slide plate 31 is separate from the moveable portion 21 but is slidably seated within the fluted, open female side rails 22F of fixed portion 22 below the moveable portion 21 while the movable portion is seated in place within the coupling. The slide plate stop valve 31 includes a second "O" ring seal 32 which is moved upwardly and held in place in sealing relationship over the sewage discharge passageway opening 22P in fixed portion 22 after removal of the moveable portion 21, and is held there due to the pressure of the seal 32 acting against the side rails 22F. In this manner, a positive acting stop valve is incorporated into the quick connect-disconnect slide coupling to prevent any back flow of pressurized sewage from the discharge conduit 25 back into the sewage collection tank 11 while the sewage grinder pump 13 is not in place.

In order to move the slide plate stop valve 31 upward from the position shown in FIG. 4 to the position where it is closed over the passageway 22P in the fixed portion of the slide coupling, a stop pin 33 is provided at the bottom end of the slide plate 31 for preventing the plate from dropping out the lower open end of female side rails 22F. A ring is secured to an accessible end of stop pin 33 and a pull lanyard 30 is attached to the ring.

To operate the slide plate stop valve 31 after the moveable portion 21 and attached sewage grinder pump 13 have been withdrawn from the collection tank 11, a serviceman on the surface of the ground pulls the lanyard 30 upwardly. Continued pulling of the lanyward 30 will lift the slide plate stop valve assembly 31 upwardly so as to position the "O" ring seal 32 around the sewage discharge passageway 22P through the fixed portion 22 of the slide coupling. At this point, pressure of the "O" ring seal 32 against the side rails 22F of the fixed portion 22 of the slide coupling, will retain the slide plate stop valve in its upper closed position. If there is any tendency for the slide plate stop valve to remain stuck in its upper position when the moveable portion 21 is returned to its assembled position on the slide coupling, the plate valve 31 readily can be driven down to its lower position via lower surface 21L of the movable portion 21 of the slide coupling assembly by pressure applied to the pipe tool 32P.

The preferred embodiment of the invention further includes an outlet discharge housing portion 44 secured to the side of the fixed portion 22 of the quick connect-disconnect slide coupling on the side thereof opposite moveable portion 21. Mounted within the outlet discharge housing portion 44 is a one-way check valve 45 specially designed to physically close over the central opening 22P through the fixed portion 22 of the slide coupling. The check valve 45 is a flapper-type check valve designed for use with sewage and is similar to the check valve disclosed in U.S. Pat. No. 3,664,775 -issued May 23, 1972 and assigned to the Environment/One Corporation, the disclosure of which hereby is incorporated into the disclosure of this application in its entirety. With the check valve 45 included in the quick connect-disconnect slide valve coupling assembly, no back pressure from the pressurized sewage outlet conduit 25 will be applied to the slide plate stop valve 31 while it is being moved to its upper closed condition as described in the preceding paragraphs. The outlet discharge housing portion 44 is secured to fixed portion 22 of the slide coupling by means of the threaded bolts 46.

Figure 2:
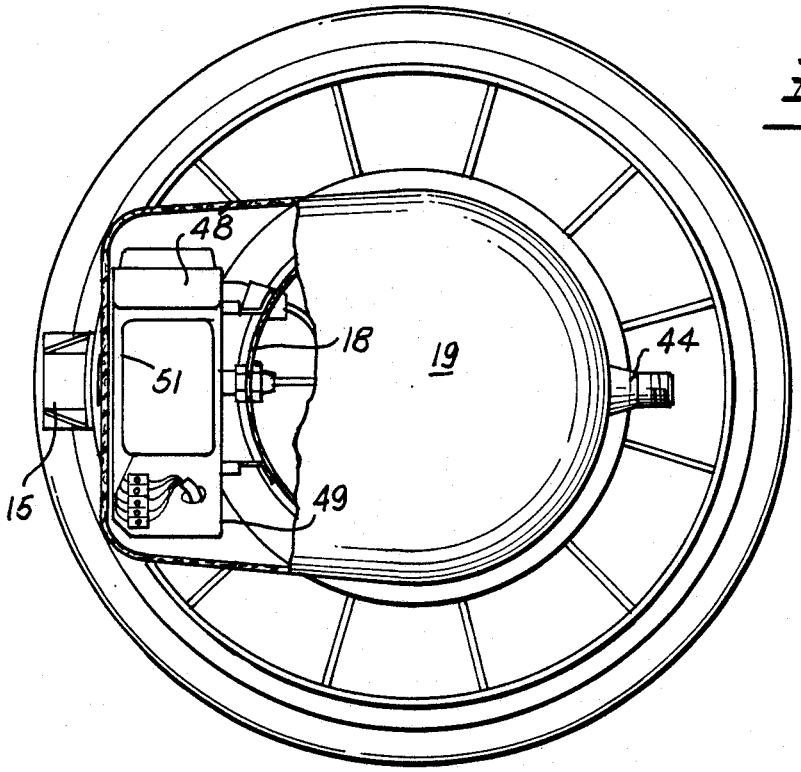
FIG. 2 is a top view, partly in section of the top of a narrow accessway enclosure the end of which appears above ground in an installed system according to the invention.

An electrical pressure sensitive switch and power supply junction box 48 is mounted within the cap 19 over the narrow access passageway 18 for supplying electric power to and controlling operation of the sewage grinder pump 13. Junction box 48 is mounted here for the purpose of making these electrical parts readily accessible at the surface of the ground, and for securing the parts high in the narrow access passageway so that they are disposed in a less moist environment than exists down at the level of the sewage grinder pump 13. As best seen in FIG. 1 and 2 of the drawings, an outside power supply conductor 47 is connected to an electrical junction box 48 which is mounted on a support bracket 49 that supports the junction box 48, the low voltage, pressure sensitive switches contained in protective housing 51 and used to control operation of the sewage grinder pump 13, and wire terminal block 52. Terminal block 52 provides easy access at the surface to terminal connection points for connecting electric wires to the house or other building being served by the sewage grinder pump system, and to provide suitable operating status and alarm signals for monitoring the status of the system.

Electric power is supplied through conductor 47 via the power terminals of the pressure sensitive switches contained in protective housing 51 and conductor 53 to the electric motor that drives the sewage grinder pump 13. This service normally would be at 240 volts - 15 amps. The sewage grinder pump 13 includes a liquid level sensor 54 of the pressure sensitive type whose pressure fluctuations are supplied up through a flexible tube 55 to the low voltage pressure sensitive switches in enclosure 51. The sewage grinder pump 13 also includes a main outlet discharge check valve shown at 56 and an antisiphon valve 57 as explained more fully in U.S. reissue patent No. 28,104 and U.S. Pat. No. 3,857,517 referenced and incorporated above.

Figure 5:
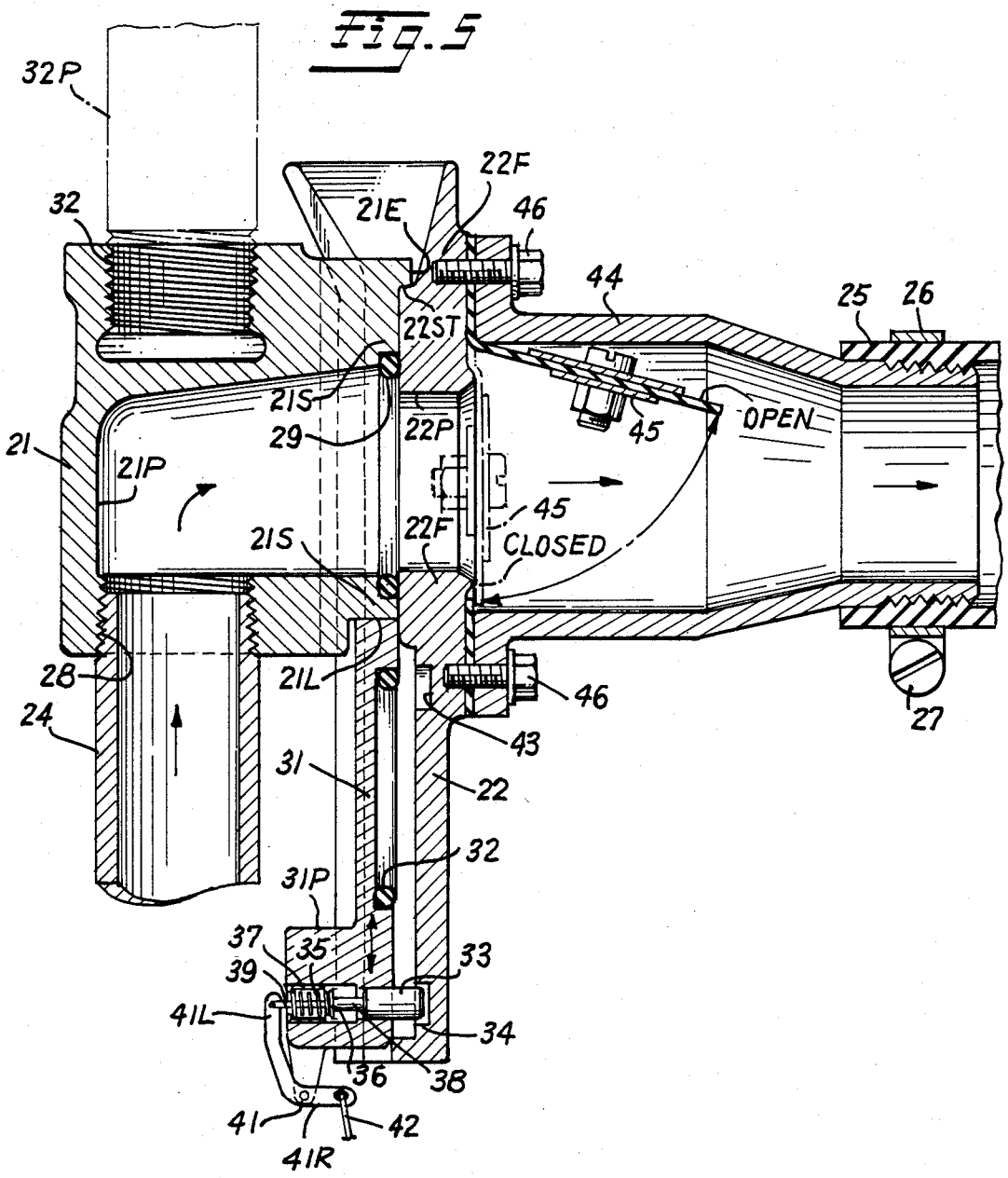
FIG. 5 is similar to FIG. 4 but illustrates an alternative embodiment of the quick connect-disconnect slide coupling used in practicing the invention.

An alternative embodiment of the two-part, quick connect-disconnect slide coupling 21, 22 is shown in FIG. 5 of the drawings. In this embodiment of the invention, the slide plate stop valve member 31 includes an integrally formed projection 31P that supports a reciprocally removable stop pin 33 that is spring biased into an opening 34 formed in the surface of the fixed portion 22 of the two-part slide coupling. The stop pin 33 is normally biased to the right as viewed in FIG. 5 by a compression spring 35 via a moveable piston member 36 slidably supported in a small cylinder 37 secured to the integral projection 31P on the slide plate stop valve member 31. The piston member 36 is secured to the stop pin 33 by means of a drive rod 38 integrally formed with the piston and the stop pin 33. Piston 36 also is connected through a connecting rod 39 to one arm 41L of an L-shaped bell crank centrally pivoted on the projection 31P at 41. The remaining arm 41R of the bell crank has its end connected to a lanyard 42 that reaches up to the surface through the narrow access passageway enclosure 18. The design is such that the projection 31P is dimensioned to fit to one side of the discharge pipe 24 so as not to interfere with the ready slide-together fit of the moveable portion 21 with the fixed portion 22 of the two-part, quick connect-disconnect slide coupling.

To operate the slide plate stop valve 31 after the moveable portion 21 and interconnected sewage grinder pump 13 have been removed from the collection tank 11, the serviceman on the surface of the ground pulls the lanyard 42 upwardly. This results in retracting stop pin 33 from the stop pin opening 34. Continued pulling of the lanyard 42 will lift the entire slide plate stop valve assembly 31 upwardly so as to position the "O" ring seal 32 around the sewage discharge passageway 22P through the fixed portion 22 of the two-part slide coupling. At this point release or lessening of the tension of the lanyard 42 will allow the stop pin 33 to be driven by compression spring 35 into an upper opening 43 formed in the fixed portion 22 of the two-part slide coupling. This results in locking the slide plate stop valve 31 in its upper closed position. When it is desired to return the sewage grinder pump to its operating position in the sewage collection tank 11 after it has been serviced, the lanyard 42 again is pulled so as to release the stop pin 33 from the upper stop opening 43 and allow the slide plate stop valve assembly 31 to drop down to its lower position with pin 33 projecting into opening 34 as shown in FIG. 5. If there is any tendency for the slide stop valve 31 to remain stuck in its upper position when the stop pin 33 is retracted, it readily can be driven down to its lower position by the lower lip 21L of the movable portion 21 into the fixed portion 22 of the slide coupling assembly, as described earlier, and engaging and driving downwardly the top of the slide stop valve 31.

From the foregoing description, it will be appreciated that the invention provides a narrow-accessway sewage collection tank and assembly for use with sewage pumps that are installed outside a building below normal ground level. The narrow-accessway sewage collection tank is designed to enclose and support a sewage pump and has a narrow-accessway enclosure connecting the top of the collection tank to the surface of the ground. The narrow accessway is of minimum diameter, but of sufficient cross-sectional dimension to allow for free passageway up and down through the accessway for installation and removal of a sewage pump. However, the narrow-accessway enclosure is not of sufficient cross-sectional dimension to accommodate a guide rail system of known design or to allow passageway of adult human beings such as servicemen for servicing the sewage grinder pump while it is installed in place within the collection tank.

The invention further provides a novel, two-part, quick connect-disconnect slide coupling together with a check valve and positive acting stop valve that can be actuated from the surface of the ground to facilitate proper installation and placement of a sewage pump in operating condition within the sewage collection tank, and for subsequent ready removal for maintenance and repair should it be required.

INDUSTRIAL APPLICABILITY

The invention describes a novel narrow-accessway sewage collection tank assembly and system for outside installation and use with residential, commercial and industrial facilitates in connection with the collection and disposal of sewage developed by such facilities. The system can be installed with minimum impact on the environment and at a lesser cost than existing systems designed for the same purpose. The sewage pump pumps liquid sewage including entrained solids collected in the collection tank and discharges the ground liquid sewage under pressure through a novel two-part, quick connect-disconnect slide coupling and an outlet discharge conduit that may be connected to a gravity sewage pipeline, a septic tank, a dry well, a drainage field, a pressure sewer system, a sewage processing plant, or the like.

Having described two embodiments of a narrow-accessway sewage grinder pump tank assembly and system constructed in accordance with the invention, it is believed obvious that other modifications and variations of the invention will be suggested to those skilled in the art in the light of the above teachings. It is therefore to be understood that changes may be made in the particular embodiments of the invention described which are within the full intended scope of the invention as defined by the appended claims.

What is claimed is:

1. A narrow accessway grinder pump system for outdoor installation below normal ground level at a sewage collection facility with minimum cost and impact on the environment while maintaining proper operating conditions, good scouring of the collection tank bottom and facilitating below ground installation and subsequent maintenance and servicing from the surface; said system comprising:

an enlarged sewage collection tank to be planted below level in the ground near a facility to be serviced and connected to suitable gravity drain conduit means interconnected between the facility to be serviced and the collection tank for collecting raw sewage therein;

sewage pump means physically supported within the enlarged collection tank and having the suction intake thereof disposed at a level below a normal low level of raw sewage content within the tank and displaced upwardly from the bottom of the collection tank a distance sufficient to assure ready flow of raw liquid sewage and entrained solids into the suction intake and proper scouring of the bottom of the tank to avoid build-up of solids thereon;

a narrow-access passageway enclosure physically supported on the top of the collection tank and providing access to the interior of the tank, said narrow-access passageway being of sufficient cross sectional dimension to allow free passageway for the sewage pump means but being insufficient in cross-section to accommodate passage of human beings or a guide rail system of conventional construction;

coupling means having a movable portion and a fixed portion for slidably receiving and supporting the movable portion, said fixed portion being secured within the collection tank for physically supporting the sewage pump by means of the movable portion thereof within the collection tank properly positioned relative to the bottom to assure proper operation of the pump means; and pressure sewage discharge outlet conduit means secured to the discharge outlet of the sewage pump means via the coupling means for transport of liquid sewage supplied under pressure from the discharge outlet of the sewage pump away from the sewage collection tank.

2. A narrow accessway sewage pump system according to claim 1 wherein the sewage pump means comprises a sewage grinder pump and the coupling means comprises a quick connect-disconnect slide coupling having the fixed portion thereof secured to the narrow access passageway enclosure substantially at the juncture thereof with the top of the collection tank and further including sealing means interposed in the quick connect-disconnect slide coupling between the fixed and movable portions thereof for providing a positive fluid-tight seal between the discharge outlet of the sewage grinder pump and the pressure sewage discharge outlet conduit means with the sewage grinder pump properly positioned in the sewage collection tank and ready for operation.

3. A narrow accessway sewage pump system according to claim 2 further including one-way check valve means interconnected to a sewage discharge outlet opening in the fixed portion of the quick connect-disconnect slide coupling intermediate the fixed portion and the pressure sewage discharge outlet conduit means to permit outward egress of pressurized sewage but blocking back flow of pressurized sewage into the collection tank.

4. A narrow accessway sewage pump system according to claim 3 further including anti-siphon valve means connected to the discharge side of the sewage grinder pump and venting it to air space above the liquid level of sewage collected in the collection tank while the sewage grinder pump is not running.

5. A narrow accessway sewage pump system according to claim 1 further including discharge outlet stop valve means comprising a part of said coupling means which is normally open with the sewage pump means in place within the sewage collection tank but which is closed upon removal of the sewage pump means from the collection tank.

6. A narrow accessway sewage pump system according to claim 4 further including discharge outlet stop valve means comprising a part of said quick connect-disconnect slide coupling which is normally open with the sewage grinder pump in place within the sewage collection tank but which is closed upon removal of the sewage grinder pump from the collection tank.

7. A narrow accessway sewage pump system according to claim 6 wherein said fixed portion of the quick connect-disconnect slide coupling forms the female half of a two-part slide-together bayonet-type fitting with the moveable portion forming the male half that slides into and is physically supported by the fixed portion, both the fixed and moveable portions have interiorly formed open passageways for passage of ground liquid sewage therethrough and which come into alignment upon the two portions being properly seated together, and the two portions further having complimentary "O" ring sealing surfaces formed thereon which come together automatically to form a liquid pressure-tight seal around the aligned interiorly formed lqiuid sewage passageways upon the moveable portion of the slide coupling being slid into and properly seated within the fixed portion.

8. A narrow accessway sewage pump system according to claim 1 wherein the moveable portion of the coupling means includes remotely operable fixture means for remote surface attachment and detachment of a surface operated sewage pump lowering and lifting tool means for installing the sewage pump and attached moveable portion of the coupling means through the narrow accessway enclosure into operating position on the fixed portion of the coupling means in the sewage collection tank or for removing the same.

9. A narrow accessway sewage pump system according to claim 7 wherein the moveable portion of the quick connect-disconnect slide coupling means includes remotely operable fixture means for remote surface attachment and detachment of a surface operated sewage grinder pump lowering and lifting tool means for installing the sewage grinder pump and attached moveable portion of the quick connect-disconnect slide coupling means through the narrow accessway enclosure into operating position on the fixed portion of the quick connect-disconnect slide coupling in the sewage collection tank or removing the same.

10. A narrow accessway sewage pump system according to claim 5 further including remote surface operated stop valve closing means extending through the narrow accessway enclosure and attached to the discharge outlet stop valve means for closing said discharge outlet stop valve means from the surface upon removal for maintenance and servicing of the sewage grinder pump and attached moveable portion of the quick connect-disconnect slide coupling from its installed position in the sewage collection tank.

11. A narrow accessway sewage pump system according to claim 9 further including remote surface operated stop valve closing means extending through the narrow accessway enclosure and attached to the discharge outlet stop valve means for closing said discharge outlet stop valve means from the surface upon removal for maintenance and servicing of the sewage grinder pump and attached moveable portion of the quick-disconnect slide coupling means from its installed position in the sewage collection tank.

12. A narrow accessway sewage pump system according to claim 1 wherein the fixed portion of the coupling means has an outwardly flaring, fluted, female, open upper and front surface for slidably receiving and capturing a complementary-shaped male sliding surface formed on the confronting opposed front and side surfaces of the moveable portion of the coupling means upon the two portions being slid together in operating relationship.

13. A narrow accessway sewage pump system according to claim 7 wherein the fixed portion of the quick connect-disconnect slide coupling has an outwardly flaring, fluted, female, open upper and front surface for slidably receiving and capturing a complementary-shaped male sliding surface formed on the complementary opposed front and side surfaces of the moveable portion of the quick connect-disconnect slide coupling upon the two portions being slid together in operating relationship.

14. A narrow accessway sewage pump system according to claim 11 wherein the fixed portion of the quick connect-disconnect slide coupling has an outwardly flaring, fluted, female, open upper and front surface for slidably receiving and capturing a complementary-shaped male sliding surface formed on the confronting opposed front and side surfaces of the moveable portion of the quick connect-disconnect slide coupling upon the two portions being slid together in operating relationship.

15. A narrow accessway sewage pump collection tank assembly for installation below normal ground level at a sewage collection facility with minimum cost and impart on the environment while maintaining proper operating conditions, good scouring of the collection tank bottom and facilitating below ground installation and subsequent maintenance and servicing from the surface; said assembly comprising:

an enlarged sewage collection tank to be planted below level in the ground near a facility to be serviced and connected to suitable gravity drain conduit means interconnected between the facility to be serviced and the collection tank for collecting raw sewage therein;

a narrow-access passageway enclosure physically supported on the top of the collection tank and providing access to the interior of the tank from the surface, said narrow-access passageway being of sufficient cross sectional dimension to allow free passageway up and down therethrough for a sewage pump means but being insufficient in cross-section to accommodate passage of human beings or a guide rail system of conventional construction;

coupling means operated from the surface for physically supporting a sewage pump means within the enlarged collection tank with the suction intake thereof disposed at a level below a normal low level of raw sewage content within the tank and displaced upwardly from the bottom of the collection tank a distance sufficient to assure ready flow of raw liquid sewage and entrained solids into the suction intake and proper scouring of the bottom of the tank to avoid build-up of solids thereon; and pressurized sewage discharge outlet conduit means connected through said coupling means for supplying pressurized ground liquid sewage from the discharge of a sewage grinder pump supported within the collection tank to a collection point exterior of the enlarged sewage collection tank.

16. A narrow accessway sewage pump collection tank assembly according to claim 15 wherein said coupling means comprises quick connect-disconnect slide coupling having a relatively short moveable portion and a relatively short fixed portion for slidably receiving and supporting the moveable portion, said relatively short fixed portion being relatively shorter than the length of the accessway and being secured to the narrow-access pasageway enclosure substantially at the juncture of the enclosure with the top of the collection tank for physically supporting a sewage grinder pump by means of the moveable portion thereof within the collection tank properly positioned relative to the bottom to assure scouring and prevent build-up of solids; and wherein the pressure sewage discharge outlet conduit means is secured through the quick connect-disconnect slide coupling means to the outlet of any sewage pump supported within the collection tank by the coupling means for transport of ground liquid sewage supplied under pressure from the discharge outlet of a sewage grinder pump away from the sewage collection tank.

17. A narrow accessway sewage pump collection tank assembly according to claim 16 further including one-way check valve means interconnected to a sewage discharge outlet opening in the fixed portion of the quick connect-disconnect slide coupling intermediate the fixed portion and the pressure sewage discharge outlet conduit means to permit outward egrees of sewage but blocking back flow of pressurized sewage into the collection tank.

18. A narrow accessway sewage pump collection tank assembly according to claim 17 further including discharge outlet stop valve means comprising a part of said quick connect-disconnect slide coupling which is normally open with a sewage grinder pump in place within the sewage collection tank but which is closed upon removal of the sewage pump from the collection tank.

19. A narrow accessway sewage pump collection tank assembly according to claim 18 wherein said fixed portion of the quick connect-disconnect slide coupling means forms the female half of a two-part slide-together bayonet-type fitting with the moveable portion forming a male half that slides into and is physcially supported by the fixed portion, both the fixed and movable portions having interiorly formed open passageways for passage of ground liquid sewage therethrough and which come into alignment upon the two portions being properly seated together, and the two portions further having complimentary "O" ring sealing surfaces formed thereon which come together automatically to form a liquid pressure-tight "O" ring seal around the aligned interiorly formed liquid sewage passageways upon the movable portion of the slide coupling being slid into and properly seated within the fixed portion.

20. A narrow accessway sewage pump collection tank assembly according to claim 16 wherein the moveable portion of the quick connect-disconnect slide coupling means includes remotely operable fixture means for remote surface attachment and detachment of a surface operated sewage pump lowering and lifting tool means for installing a sewage pump and attached moveable portion of the quick connect-disconnect slide coupling means through the narrow accessway enclosure into operating position on the relatively short fixed portion of the quick connect-disconnect slide coupling within the sewage collection tank or for removing the same.

21. A narrow accessway sewage pump collection tank assembly according to claim 19 wherein the moveable portion of the quick connect-disconnect slide coupling means includes remotely operable fixture means for remote surface attachment and detachment of a surface operated sewage pump lowering and lifting tool means for installing a sewage pump and attached movable portion of the quick connect-disconnect slide coupling means through the narrow accessway enclosure into operating position on the relatively short fixed portion of the quick connect-disconnect slide coupling within the sewage collection tank or for removing the same.

22. A narrow accessway sewage pump collection tank assembly according to claim 18 further including remote surface operated stop valve closing means extending through the narrow accessway enclosure and attached to the discharge outlet stop valve means for closing said discharge outlet stop valve means from the surface upon removal for maintenance and servicing of a sewage pump means and attached moveable portion of the quick connect-disconnect slide coupling means from its installed position in the sewage collection tank.

23. A narrow accessway sewage pump collection tank assembly according to claim 21 further including remote surface operated stop valve closing means extending through the narrow accessway enclosure and attached to the discharge outlet stop valve means for closing said discharge outlet stop valve means from the surface upon removal for maintenance and servicing of a sewage pump means and attached moveable portion of the quick connect-disconnect slide coupling means from its installed position in the sewage collection tank.

24. A narrow accessway sewage pump collection tank assembly according to claim 16 wherein the fixed portion of the quick connect-disconnect slide coupling has an outwardly flaring, fluted, female, open upper and front surface for slidably receiving and capturing a complementary-shaped male sliding surface formed on the confronting opposed front and side surfaces of the moveable portion of the quick connect-disconnect slide coupling upon the two portions being slid together in operating relationship.

25. A narrow accessway sewage pump collection tank assembly according to claim 23 wherein the fixed portion of the quick connect-disconnect slide coupling has an outwardly flaring, fluted, female, open upper and front surface for slidably receiving and capturing a complementary-shaped male sliding surface formed on the confronting front and side surfaces of the moveable portion of the quick connect-disconnect slide coupling upon the two portions being slid together in operating relationship.

26. A narrow accessway sewage pump remotely operable, two-part, quick connect-disconnect slide coupling having a fixed portion that forms half of a two-part slide-together bayonet-type coupling with the moveable portion forming the remaining half that slides together with and is physically supported by the fixed portion, both the fixed and movable portions have interiorly formed open passageways for passage of ground liquid sewage therethrough and which come into alignment upon the two portions being properly seated together, and the two portions further have complimentary "O" ring sealing surfaces formed thereon which come together automatically to form a liquid pressure tight seal around the aligned interiorly formed liquid sewage passageways upon the moveable portion of the slide coupling being slid into and properly seated within the fixed portion, and further including a discharge outlet slide stop valve comprising apart of said quick connect-disconnect slide coupling which is normally open but which is closed upon removal of a sewage pump from a collection tank within which a sewage pump is mounted by said slide coupling.

27. A narrow accessway sewage pump system slide coupling according to claim 26 further including one-way check valve means interconnected to a sewage discharge outlet opening in the fixed portion of the quick connect-disconnect slide coupling intermediate the fixed portion and a pressure sewage discharge outlet conduit means to permit outward egress of pressurized sewage but blocking back flow of pressurized sewage into the collection tank.

28. A narrow accessway sewage pump system slide coupling according to claim 27 further including sealing means interposed it the quick connect-disconnect slide coupling between the fixed and movable portions thereof for providing a positive fluid-tight seal between the discharge outlet of a sewage pump and a pressure sewage discharge outlet conduit.

29. A narrow accessway sewage pump system slide coupling according to claim 28 wherein the moveable portion of the quick connect-disconnect slide coupling includes remotely operable fixture means for remote surface attachment and detachment of a surface operated sewage grinder pump lowering and lifting tool means for installing a sewage pump attached to the moveable portion of the quick connect-disconnect slide coupling through a narrow accessway enclosure into operating position on the fixed portion of the quick connect-disconnect slide coupling secured in a sewage collection tank or for remvoing the same.

30. A narrow accessway sewage pump system slide coupling according to claim 29 further including remote surface operated stop valve closing means extending through the narrow accessway enclosure and attached to the discharge outlet slide stop valve for closing said discharge outlet slide stop valve from the surface upon removal for maintenance and servicing of a sewage pump and attached moveable portion of the quick connect-disconnect slide coupling from its installed position in a sewage collection tank.

31. A narrow accessway sewage pump slide coupling according to claim 26 wherein the fixed portion of the quick connect-disconnect slide coupling means has an outwardly flaring, fluted, relatively wide, open upper and front surface for slidably receiving and capturing a complementary-shaped sliding surface formed on the confronting opposed front and side surfaces of the moveable portion of the quick connect-disconnect slide coupling upon the two portions being slid together in operating relationship, and for providing relatively strong widely based physical support for a sewage pump supported for resisting torsional forces developed by a sewage pump secured to the moveable portion.

32. A narrow accessway sewage pump slide coupling according to claim 30 wherein the fixed portion of the quick connect-disconnect slide coupling means has an outwardly flaring, fluted, relatively wide, open upper and front surface for slidably receiving and capturing a complementary-shaped sliding surface formed on the confronting opposed front and side surfaces of the moveable portion of the quick connect-disconnect slide coupling upon the two portions being slid together in operating relationship, and for providing relatively strong widely based physical support for resisting torsional forces developed by a sewage pump secured to the moveable portion.

* * * * *